US010687138B2

(12) United States Patent
Mainini et al.

(10) Patent No.: US 10,687,138 B2
(45) Date of Patent: Jun. 16, 2020

(54) CONFORMABLE HEADSET EARLOOP FOR STABILITY AND COMFORT

(71) Applicant: Plantronics, Inc., Santa Cruz, CA (US)

(72) Inventors: Matthew J. Mainini, Santa Cruz, CA (US); Chase Patrick Bailey, Santa Cruz, CA (US); Bowman Wang, Ben Lomond, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 16/125,565

(22) Filed: Sep. 7, 2018

(65) Prior Publication Data

US 2020/0084531 A1 Mar. 12, 2020

(51) Int. Cl.
*H04R 1/10* (2006.01)
*H04R 3/12* (2006.01)

(52) U.S. Cl.
CPC ..... *H04R 1/105* (2013.01); *H04R 1/1016* (2013.01); *H04R 1/1066* (2013.01); *H04R 3/12* (2013.01)

(58) Field of Classification Search
CPC .... H04R 1/105; H04R 1/1016; H04R 1/1066; H04R 3/12; H04R 2201/10–109
USPC ..... 381/381, 370, 374, 386
See application file for complete search history.

(56) References Cited

U.S. PATENT DOCUMENTS 4,453,050 A * 6/1984 Enokido ..... H04R 1/1066 381/330
4,917,504 A * 4/1990 Scott ..... H04M 1/05 381/330
5,412,736 A * 5/1995 Keliiliki ..... H04R 1/105 381/330
5,761,298 A * 6/1998 Davis ..... H04M 1/05 379/430

(Continued)

FOREIGN PATENT DOCUMENTS

CN 204425588 U 6/2015
CN 206149457 U 5/2017

(Continued)

OTHER PUBLICATIONS

Shi Shengyang, Neck-band style ear-hanging earphone, has two earphone hanging pieces connected with connecting pieces . . . , 2020 Thomson Reuters, CN-202652490-U.*

(Continued)

*Primary Examiner* — Alexander Krzystan
(74) *Attorney, Agent, or Firm* — Chuang Intellectual Property Law

(57) ABSTRACT

Methods and apparatuses for earloops are described. In one example, an earloop for wearing on an ear of a user head is described. The earloop includes a capsule connector segment for coupling to a headset capsule, and an apex segment having an adaptive apex curvature arranged to rest on an apex of the ear. The earloop further includes a behind-the-ear segment having an adaptive behind-the-ear curvature arranged to curve behind the ear and exert a resilient (Continued)

gripping tension behind the ear, wherein the capsule connector segment is located along the x-axis at a different location than the behind-the-ear segment in both a static non-worn state and a static worn state, and wherein the apex segment is between the capsule connector segment and the behind-the-ear segment.

17 Claims, 9 Drawing Sheets

(56) References Cited

U.S. PATENT DOCUMENTS

| | | | | |
|---|---|---|---|---|
| 6,104,824 | A * | 8/2000 | Ito | H04R 5/0335 379/430 |
| 6,449,374 | B1 * | 9/2002 | Skulley | H04R 1/083 381/330 |
| 6,580,800 | B1 * | 6/2003 | Yamasaki | H04R 1/105 381/379 |
| 6,728,387 | B1 * | 4/2004 | Polito | H04R 1/105 381/375 |
| 6,785,396 | B2 * | 8/2004 | Shirata | H04R 1/105 381/374 |
| 7,873,177 | B2 * | 1/2011 | Okamura | H04R 1/105 381/374 |
| 9,319,769 | B2 * | 4/2016 | Burgett | H04R 1/105 |
| 9,949,014 | B2 * | 4/2018 | Cramer | H04R 1/1041 |
| 10,257,604 | B2 * | 4/2019 | Birath | H04R 1/105 |
| 2003/0169898 | A1 * | 9/2003 | Arasawa | H04R 1/1066 381/383 |
| 2011/0170703 | A1 | 7/2011 | Palma | |
| 2014/0307891 | A1 * | 10/2014 | Burgett | H04R 1/105 381/74 |
| 2015/0063622 | A1 * | 3/2015 | Wallace | H04R 1/105 381/374 |
| 2015/0086059 | A1 | 3/2015 | Gougherty et al. | |
| 2015/0319526 | A1 * | 11/2015 | Kunimoto | H04R 1/10 381/74 |
| 2016/0100237 | A1 * | 4/2016 | Blouse | H04R 1/105 381/378 |
| 2017/0223445 | A1 * | 8/2017 | Bullen | H04R 1/1041 |
| 2018/0098153 | A1 * | 4/2018 | Jan | H04R 5/0335 |
| 2019/0075389 | A1 * | 3/2019 | Jan | H04R 1/1041 |
| 2019/0222936 | A1 * | 7/2019 | Degner | H04R 1/1008 |

FOREIGN PATENT DOCUMENTS

| | | | |
|---|---|---|---|
| WO | WO 2014/041610 | A1 | 3/2014 |
| WO | WO 2016/110164 | A1 | 7/2016 |

OTHER PUBLICATIONS

Unknown, "The Perfect Workout Partner, Plantronics BackBeat FIT Offers Superior Stability, Comfort and Wireless Freedom," Press Release—Plantronics, Inc., Feb. 23, 2014, 3 pages. Found at URL <https://newsroom.poly.com/press-release/consumer/perfect-workout-partner-plantronics-backbeat-fit-offers-superior-stability-co>.

PCT International Search Report and Written Opinion of the International Searching Authority dated Nov. 4, 2019 for International Application No. PCTUS2019/050017, filed Sep. 6, 2019 (16 pages.

* cited by examiner

CONFORMABLE HEADSET EARLOOP FOR STABILITY AND COMFORT

BACKGROUND OF THE INVENTION

Various audio products exist in which an electro-acoustic transducer such as a speaker (also referred to herein as a receiver) is placed in the user's ear. For example, "in-the-ear" (also referred to as ear bud or concha style) headsets or headphones transmit sounds to the ear of the user by means of a small speaker sized to fit in the cavum concha in front of the ear canal. Conventional ear bud headsets position the speaker inside the cavum concha between the tragus and anti-tragus to establish placement and support on the ear.

Different ear shapes and sizes make it difficult for a single design to fit the ear correctly, stabilize the headset, and be comfortable for the user. Shape and size variations of the concha in human ears results in instability for users whose concha do not hold the headset with sufficient force or discomfort to those with smaller concha. Without additional support, these devices can become loose (i.e., unstable) and audio quality is lost or degraded. As a solution, the speaker is typically designed for a minimally sized concha and secured in place by an earloop which fits around the outside of the ear.

Conventional earloops are typically rigid to provide sufficient stability, but cause user discomfort either immediately upon donning or over time during extended wear. Rigid earloops are unable to conform to specific sizes and shapes of user ears. This is problematic as there are large variations in size and shape of human ears. For example, a rigid earloop providing a secure fit may cause undesirable and uncomfortable pressure points on a relatively large ear. In contrast, earloops that are too soft throughout the entire earloop provide insufficient stability. As such, there is conflict between the dual goals of an earloop having both stability and comfort.

As a result, there is a need for improved methods and apparatuses for earloops.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
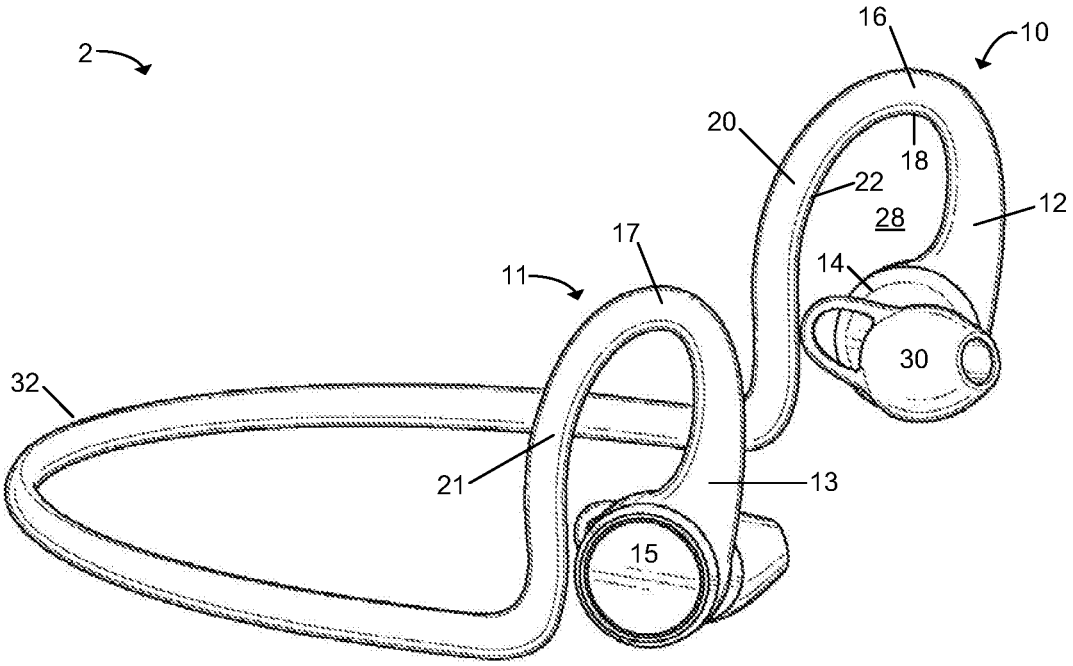
FIG. 1 illustrates a perspective view of a headset utilizing left and right earloops and a neckband in one example embodiment.

Methods and apparatuses for earloops are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various embodiments of the invention, although different, are not necessarily mutually exclusive. Thus, a particular feature, characteristic, or structure described in one example embodiment may be included within other embodiments unless otherwise noted.

The inventors have recognized certain limitations in current headset earloops. An improved flexible earloop having extremely refined parts to balance many factors is described. These factors include: fit for a large percentage of the population, ease in donning the device, short term comfort, long term comfort, stability during activity, stability during no activity, manufacturing process, aesthetic design, durability, and others. In various embodiments, the earloop is round at the bottom and intentionally wide to cradle over apex and distribute pressure. The earloop apex flexes vertically and horizontally in equal measures, roughly half of the force required of prior art designs. The flexibility of the earloop tapers from the apex (softer is optimal) down to the bottom of the earloop (stiffer is optimal). This flexibility is achieved mostly by the inherent strength of the geometry of the earloop (i.e., the earloop apex is more curved than the lower portion of the earloop). In one embodiment, the bottom of the earloop bends inward approximately five mm at the bottom of the earloop, allowing the earloop to hug the head. In a neckband embodiment, the bend directs the neckband inward rather than outward to prevent touching anti-helix.

The earloop twists inward approximately eleven degrees to conform and cradle skull for a longer touch point which improves comfort and stability, and allows the headset to "disappear" from the users notice while wearing. The earloop geometry is designed to fit more against the head while being snug as well as fitting 90% of the population, from 5-95 percentile ears. The durometer of earloop, 80 Shure-A, is selected to promote flexibility at the ear apex while remaining stiff enough to stay on ear during sport activity.

Advantageously, the earloop has improved donning ease, stability, fit, and comfort compared to prior designs. With this earloop, the headset stays on the ear during rigorous sport activity while remaining comfortable as well. A single earloop may be used in place of multiple sized earloops.

In one example embodiment, an earloop for wearing on an ear of a user head is described. As described herein, the user head is referenced by an x-axis in a width direction from ear-to-ear, a y-axis in a height direction from head-to-toe, and a z-axis in a depth direction from face-to-occiput. The earloop includes a capsule connector segment for coupling to a headset capsule, and an apex segment having an adaptive (i.e., conformable to a user ear) apex curvature arranged to rest on an apex of the ear. The earloop further includes a behind-the-ear segment having an adaptive behind-the-ear curvature arranged to curve behind the ear and exert a resilient gripping tension behind the ear. The capsule connector segment is located along the x-axis at a different location than the behind-the-ear segment in both a static non-worn state and a static worn state. The apex segment is between the capsule connector segment and the behind-the-ear segment.

In one example embodiment, a headset for wearing on a user head is described. The headset includes a capsule, wherein the capsule includes a speaker arranged to output sound into an ear when the headset is worn. The headset includes an earloop extending from the capsule. The earloop includes a capsule connector segment coupled to the capsule, an apex segment having an adaptive apex curvature arranged to rest on an apex of the ear, and a behind-the-ear segment having an adaptive behind-the-ear curvature arranged to curve behind the ear. The adaptive apex curvature and the adaptive behind-the-ear curvature exert a resilient gripping tension behind the ear. The capsule connector segment is located along the x-axis at a different location than the behind-the-ear segment in both a static non-worn state and a static worn state.

In one example embodiment, a headset for wearing on a user head is described. The headset includes a left capsule and a left earloop. The left capsule includes a left speaker arranged to output sound into a left ear when the headset is worn. The left earloop extends from the left capsule. The left earloop includes a left capsule connector segment coupled to the left capsule, a left apex segment having an adaptive left apex curvature arranged to rest on a left apex of the left ear, and a left behind-the-ear segment having an adaptive left behind-the-ear curvature arranged to curve behind the left ear. The adaptive left apex curvature and the adaptive left behind-the ear curvature exert a left resilient gripping tension behind the left ear. The left capsule connector segment is located along the x-axis at a different left location than the left behind-the-ear segment in both a left static non-worn state and a left static worn state. The left apex segment is between the left capsule connector segment and the left behind-the-ear segment.

The headset includes a right capsule and a right earloop. The right capsule includes a right speaker arranged to output sound into a right ear when the headset is worn. The right earloop extends from the right capsule. The right earloop includes a right capsule connector segment coupled to the right capsule, a right apex segment having an adaptive right apex curvature arranged to rest on a right apex of the right ear, and a right behind-the-ear segment having an adaptive right behind-the-ear curvature arranged to curve behind the right ear. The adaptive right apex curvature and the adaptive right behind-the ear curvature exert a right resilient gripping tension behind the right ear. The right capsule connector segment is located along the x-axis at a different right location than the right behind-the-ear segment in both a right static non-worn state and a right static worn state. The right apex segment is between the right capsule connector segment and the right behind-the-ear segment.

The headset further includes a neckband integrated with the left earloop and the right earloop. The neckband includes a first end coupled to the left behind-the-ear segment and a second end coupled to the right behind-the-ear segment.

In one example embodiment, a neckband for use with a headset worn on a user head is described. The neckband includes a first neckband end for coupling with a left earloop and a second neckband end for coupling with a right earloop. The neckband includes a neckband length along the x-axis between the first neckband end and the second neckband end. The neckband length has a variable height in the y-axis direction.

In one example embodiment, a headset for wearing on a user head is described. The headset includes a left capsule, wherein the left capsule includes a left speaker arranged to output sound into a left ear when the headset is worn. The headset includes a left earloop extending from the left capsule. The left earloop includes a left capsule connector segment coupled to the left capsule, a left apex segment having an adaptive left apex curvature arranged to rest on a left apex of the left ear, and a left behind-the-ear segment having an adaptive left behind-the-ear curvature arranged to curve behind the left ear. The adaptive left apex curvature and the adaptive left behind-the ear curvature exert a left resilient gripping tension behind the left ear.

The headset further includes a right capsule, wherein the right capsule includes a right speaker arranged to output sound into a right ear when the headset is worn. The headset includes a right earloop extending from the right capsule. The right earloop includes a right capsule connector segment coupled to the right capsule, a right apex segment having an adaptive right apex curvature arranged to rest on a right apex of the right ear, and a right behind-the-ear segment having an adaptive right behind-the-ear curvature arranged to curve behind the right ear. The adaptive right apex curvature and the adaptive right behind-the ear curvature exert a right resilient gripping tension behind the right ear.

The headset further includes a neckband integrated with the left earloop and the right earloop. The neckband includes a first end coupled to the left behind-the-ear segment, a second end coupled to the right behind-the-ear segment, and a neckband length along the x-axis between the first neckband end and the second neckband end. The neckband length has a variable height in the y-axis direction.

Figure 2A:
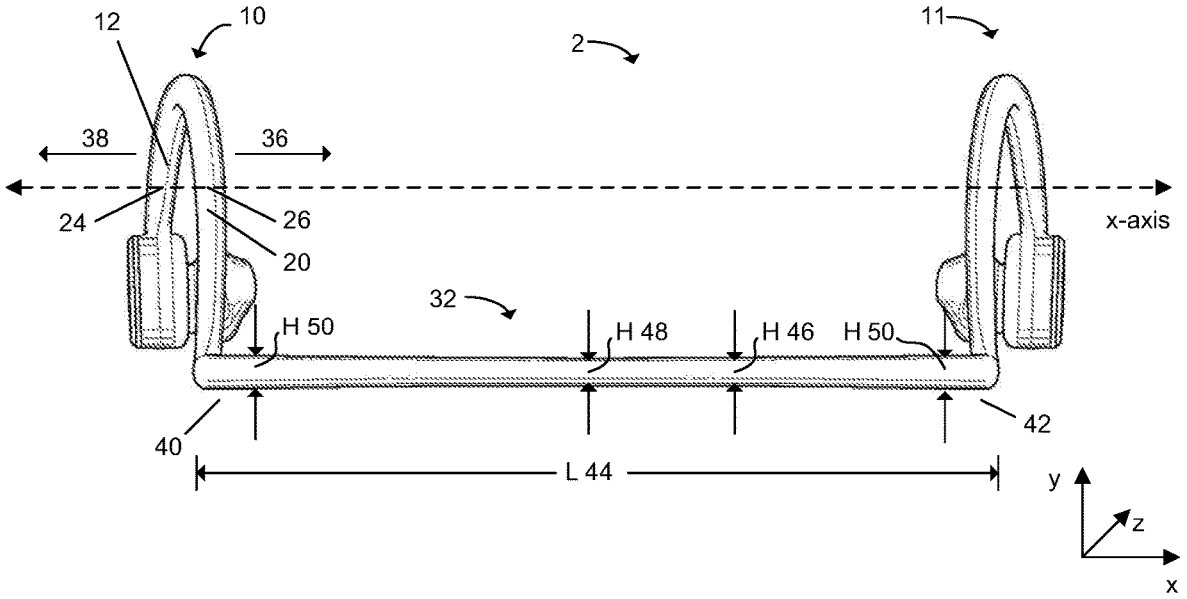
FIG. 2A illustrates a rear view of the headset shown in FIG. 1.
Figure 3:
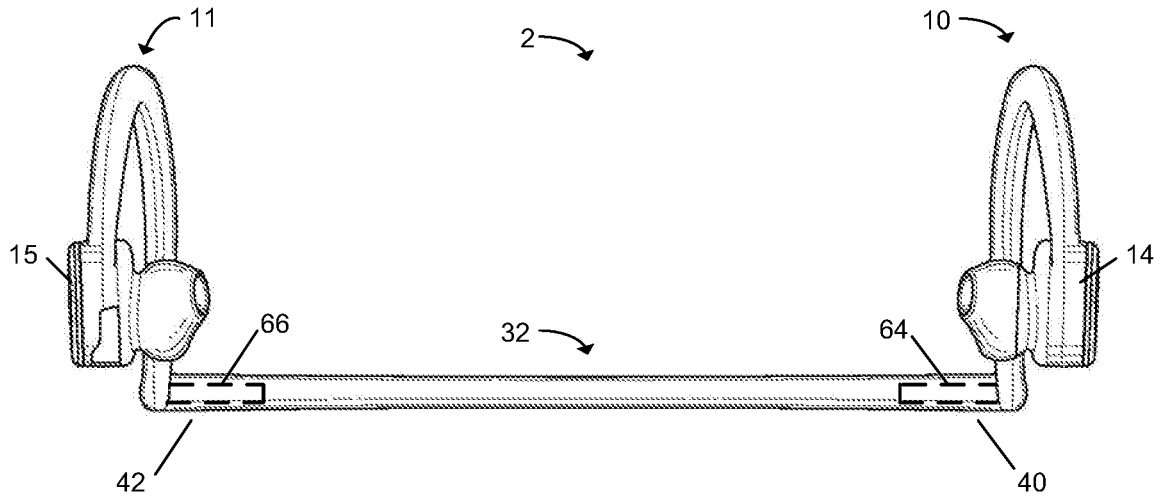
FIG. 3 illustrates a front view of the headset shown in FIG. 1.
Figure 4:
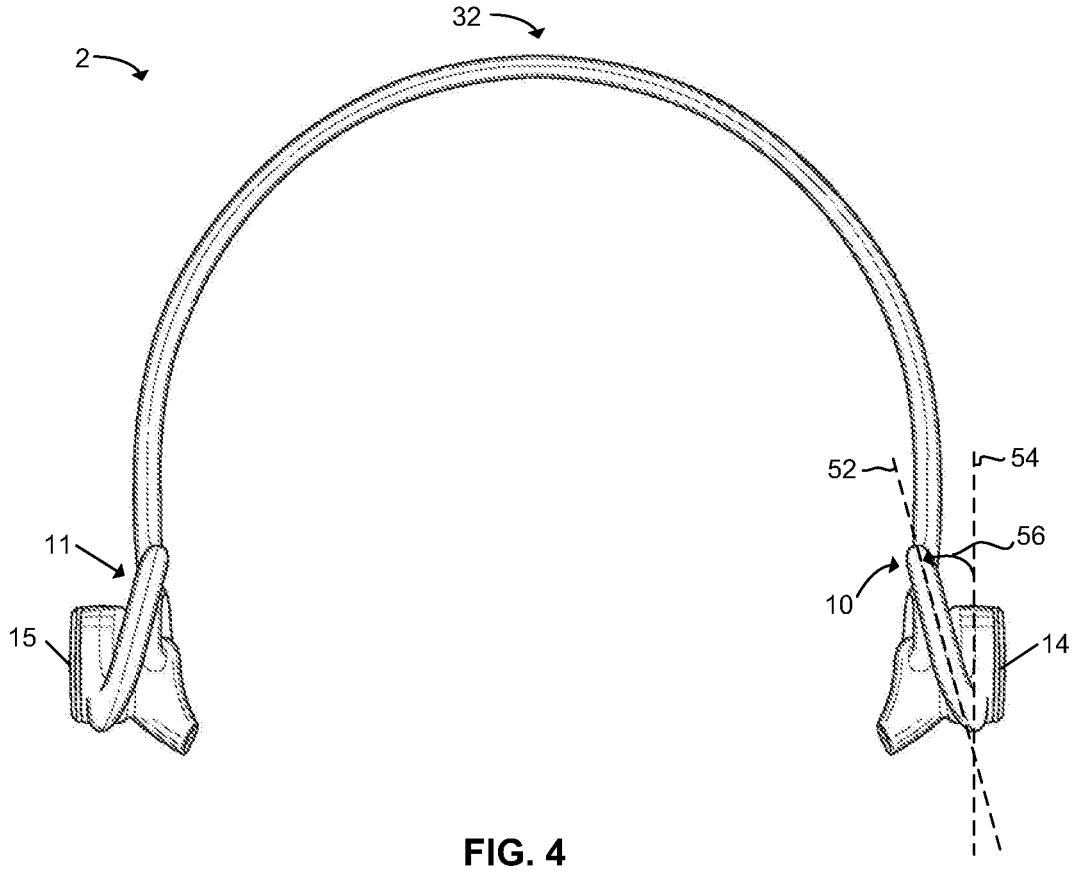
FIG. 4 illustrates a top view of the headset shown in FIG. 1.
Figure 5:
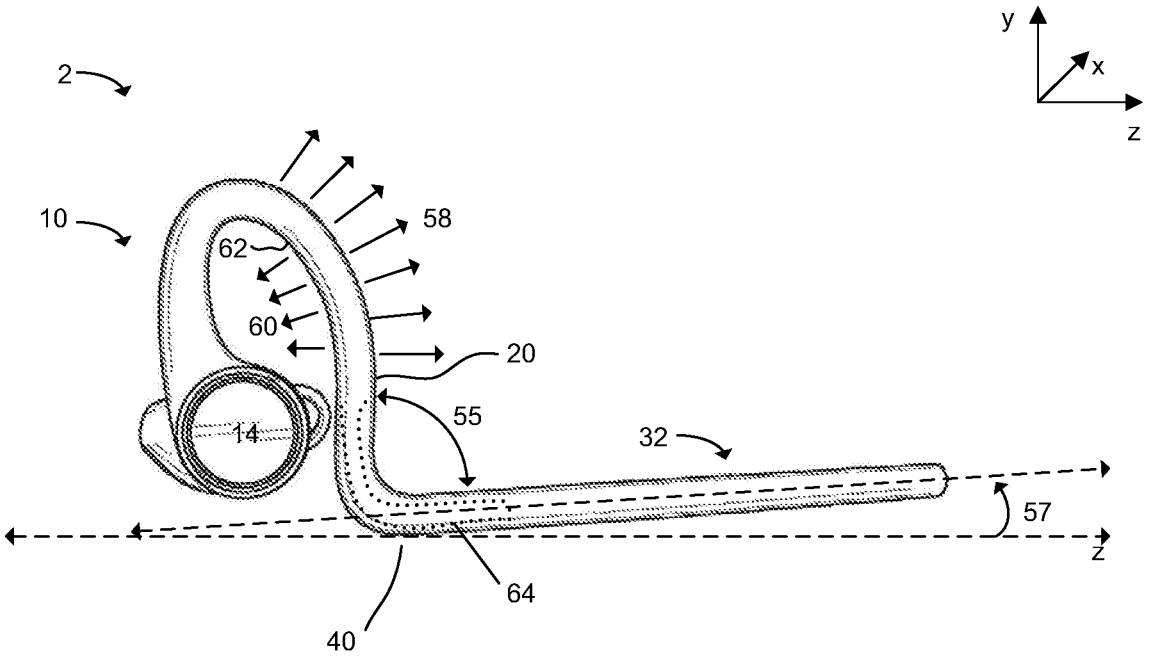
FIG. 5 illustrates a left view of the headset shown in FIG. 1.
Figure 6:
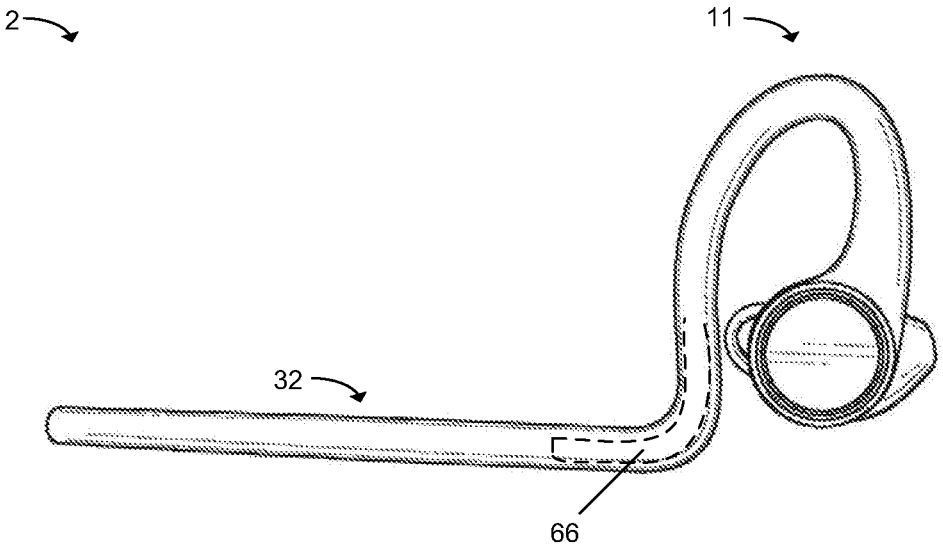
FIG. 6 illustrates a right view of the headset shown in FIG. 1.

FIGS. 1, 2A, and 3 illustrate a perspective, rear, and front view, respectively, of a headset 2 utilizing a left earloop 10, a right earloop 11, and a neckband 32 in one example embodiment. FIGS. 4-6 illustrate a top, left, and right view, respectively of the headset 2. As illustrated, headset 2 is shown in a static state with no external force applied. Headset 2 is worn on a user head. As described herein, the user head is referenced by an x-axis in a width direction from ear-to-ear, a y-axis in a height direction from head-to-toe and a z-axis in a depth direction from face-to-occiput.

Headset 2 includes a left capsule 14 and a left earloop 10. The left capsule 14 includes a left speaker arranged to output sound into a left ear when the headset 2 is worn. Located over the left speaker is a left eartip 30 arranged to stabilize the headset 2 when inserted into the left ear. The left earloop 10 is configured such that the left speaker via left eartip 30 is properly positioned at the entrance of the ear canal. Proper positioning of the left speaker at the entrance of the ear canal increases sound quality and volume of sound output heard by the wearer.

The left earloop 10 extends from the left capsule 14. The left earloop 10 includes a left capsule connector segment 12 coupled to the left capsule 14. A left apex segment 16 having an adaptive left apex curvature 18 is arranged to rest on a left apex of the left ear. The left earloop 10 further includes a left behind-the-ear segment 20 having an adaptive left behind-the-ear curvature 22 arranged to curve behind the left ear as determined by the contours behind the ear. The left apex segment 16 is between the left capsule connector segment 12 and the left behind-the-ear segment 20. Although described as different segments to refer to the different functions and/or relationships to the ear, it is recognized left earloop 10 is a continuous loop and does not have precise delineated boundaries between segments. The left capsule connector segment 12, the left apex segment 16, and the left behind-the-ear segment 20 define an open-ended curved space 28. The left behind-the-ear segment 20 is integrated with a neckband 32 at a termination end opposite the left apex segment 16. In operation, the adaptive left apex curvature 18 and the adaptive left behind-the-ear curvature 22 may exert a left resilient gripping tension behind the left ear.

When headset 2 is placed on the user head, left earloop 10 hangs from the apex of the left ear and conformably wraps around and grips behind the ear. When worn, the left earloop 10 may not return to its prior static shape as the user ear and/or side of the user head may apply an external force. Left earloop 10 prevents the speaker from being dislodged from its proper position and evenly distributes the weight of the headset.

The left earloop 10 may be composed of an elastomer such as a silicone rubber material having approximately 80 Shore-A hardness. In further examples, other elastomers may be used. In one embodiment, the left earloop 10 is formed of a single material and is a single continuous piece. In a further example, left earloop 10 is formed from multiple materials. For example, one or more segments of left earloop 10 may be formed from both an elastomer and a plastic material.

Within the silicone rubber material may be a plastic substrate at one or more locations. The plastic substrate may be utilized to control the rigidity of particular segments of left earloop 10. For example, left capsule connector segment 12 may have a plastic substrate immediately proximate the left capsule 14 extending approximately 8-10 mm from the left capsule 14.

The left earloop 10 includes a wide and rounded surface arranged to sit on the apex of the ear and behind the ear. Left apex segment 16 has a width of approximately five mm. With this arrangement, left earloop 10 cradles over the apex and evenly distributes pressure, providing improved comfort.

The headset 2 includes a right capsule 15 and a right earloop 11. The right capsule 15 includes a right speaker arranged to output sound into a right ear when the headset 2 is worn. The right earloop 11 extends from the right capsule 15. The right earloop 11 includes a right capsule connector segment 13 coupled to the right capsule 15, a right apex segment 17 having an adaptive right apex curvature arranged to rest on a right apex of the right ear, and a right behind-the-ear segment 21 having an adaptive right behind-the-ear curvature arranged to curve behind the right ear. The adaptive right apex curvature and the adaptive right behind-the ear curvature exert a right resilient gripping tension behind the right ear. Similar to the left side components, the right capsule connector segment 13 is located along the x-axis at a different right location than the right behind-the-ear segment 21 in both a right static non-worn state and a right static worn state. The right apex segment 17 is between the right capsule connector segment 13 and the right behind-the-ear segment 21. Right earloop 11 operates in the same manner as left earloop 10 and is not described separately.

Advantageously, as illustrated in FIG. 2A, the left capsule connector segment 12 is located along the x-axis at a different location 24 than the location 26 of the left behind-the-ear segment 20 in both a left static non-worn state and a left static worn state. In one example, the left earloop 10 is substantially helical to achieve the desired positioning of the left capsule connector segment 12 and the left behind-the ear segment along the x-axis. This arrangement provides an improved match with the ear anatomy, resulting in improved comfort. For example, the helical configuration assists in properly positioning the side of the left behind-the-ear segment 20 to maximize contact with (i.e., "hug") the side of the user head, further improving stabilization with increased friction during head movement.

Advantageously, as also illustrated in FIG. 2A, the left earloop 10 is resiliently flexible inward in a first direction 36 along the x-axis towards a side of a wearer head and resiliently flexible outward in a second direction 38 along the x-axis away from the side of the wearer head. As such, left earloop 10 has flexibility to ease donning and automatically adapts to a shape of the ear upon release by the user when the left earloop 10 flexes to rest at the necessary horizontal distance along the x-axis between the side of the user head and the capsule inserted in the user ear.

Advantageously, as illustrated in FIG. 4, the left apex segment 16 and the left behind-the-ear segment 20 substantially define a first plane 52. The first plane 52 intersects (i.e., it is not in the same plane) a y-z plane 54 through a center of the capsule parallel to a wearer head. For example, first plane 52 is at an angle 56 of nine to thirteen degrees from the y-z plane 54 through the center of the capsule. With this advantageous arrangement, the left earloop 10 twists inward to conform and cradle the user skull for a longer touch point, thereby improving comfort, stability, and allowing the headset to "disappear" from the users notice while wearing. In comparison, prior art designs typically utilize a "flat" or vertically aligned design (i.e., angle 56 is zero degrees). The inventors have recognized that the prior art "flat" designs do not conform as well to the user head shape, having fewer touch points. The inventors have recognized the fewer touch points result in pressure on a smaller area of skin, increasing irritation as this skin behind the ear is particularly sensitive.

Advantageously, as illustrated in FIG. 5, the left earloop 10 is resiliently flexible outward in a first direction 58 in a y-z plane (i.e., along the z-axis and the y-axis) to increase the size of the open-ended curved space 28 and adjust a curvature 62 of an inner surface of the left earloop 10 during the donning process. Upon release by the user following donning, left earloop 10 resiliently flexes back inward in a second direction 60 to reduce the size of the open-ended curved space 28, applying a grasping force on the ear resulting from the curvature 62 of the inner surface of the left earloop 10 automatically adapting (i.e., conforming) to a shape of the ear. This conformability provides a fit having improved donning, stability and comfort for a wide range of ear shapes and sizes.

As a further advantage, the left apex segment 16 has a first flexibility amount in the first direction 58 and the left behind-the-ear segment 20 has a second flexibility amount in the first direction 58, wherein the first flexibility amount is greater than the second flexibility amount. The flexibility of the left earloop 10 tapers from the apex (softer is optimal) down to the bottom of the left earloop 10 (stiffer is optimal). This is achieved mostly by the inherent strength of the geometry of the earloop (i.e., the left apex segment 16 is more curved than the left behind-the-ear segment 20).

In operation, the left apex segment 16 deforms a greater amount to adjust the inner curvature of the left apex segment 16 than the amount the behind-the ear segment deforms for a given force applied by the user while donning the left earloop 10. The capsule connector segment 12 may have little or no flexibility. The greater flexibility of the left apex segment 16 (and therefore greater adjustability of the inner curvature of the left apex segment 16) advantageously assists in the donning process when placing the earloop on the ear and furthermore allows the left apex segment 16 to comfortably, but firmly, grasp the ear apex upon completion of donning and while in a resting worn state. In one embodiment, the left apex segment 16 flexes vertically (i.e., in first direction 58 and second direction 60) and horizontally (i.e., in first direction 36 and second direction 38) in equal measures. The durometer of the left earloop 10 may be approximately 80 Shure-A to promote flexibility at the apex while remaining sufficiently stiff to stay on the ear during activities requiring user movement, such as sporting activities.

In one example, the left behind-the-ear segment 20 includes a side surface comprising a curvature at a termination end (i.e., the end opposite the left apex segment 16) directing the termination end along the x-axis towards contact with the user head. With this advantageous arrangement, the left behind-the-ear segment 20 hugs the wearer's head and sends neckband 32 inward rather than outward to prevent touching the anti-helix of the user ear.

The headset 2 further includes a neckband 32 integrated with the left earloop 10 and the right earloop 11. The neckband 32 includes a first neckband end 40 coupled to the left behind-the-ear segment 20 and a second neckband end 42 coupled to the right behind-the-ear segment 21.

In one example embodiment, as illustrated in FIG. 2A, neckband 32 includes a first neckband end 40 for coupling with the left earloop 10, a second neckband end 42 for coupling with the right earloop 11, and a neckband length L 44 along the x-axis between the first neckband end 40 and the second neckband end 42. In one example, the neckband length L 44 is approximately 250-255 mm. Advantageously, neckband length L 44 is shorter than prior art designs, which typically are greater than 260 mm, while still fitting the same percentage of users as the prior art designs. This advantage is achieved by the improved apex flexibility in first direction 58 (described in reference to FIG. 5) which allows movement of the neckband rearward on the z-axis. A shorter neckband length L 44 result in less weight and less cantilever, resulting in less "bounce" during activities requiring vigorous movement such as running.

Figure 2B:
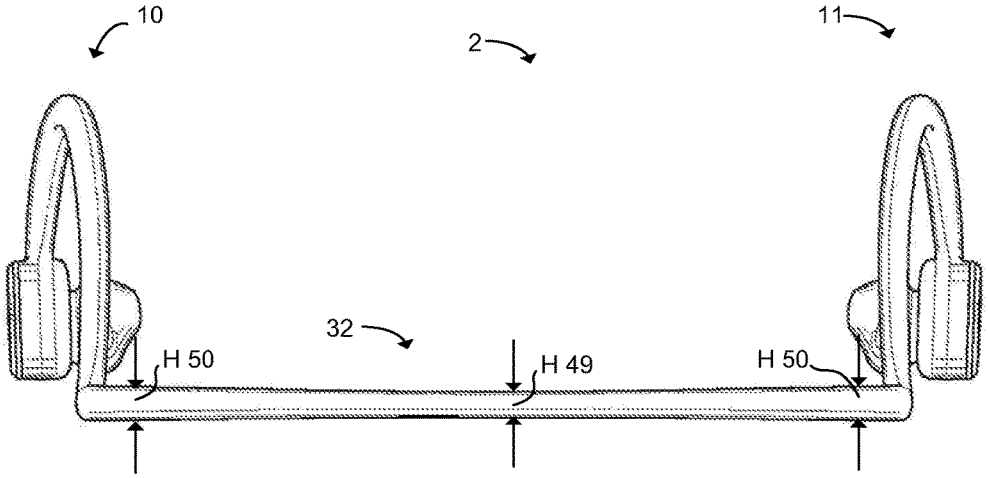
FIG. 2B illustrates a rear view of the headset shown in FIG. 1 in a further embodiment.

Neckband length L 44 has a variable height H 46 in the y-axis direction. The variable height H 46 is at a minimum height H 48 at a midpoint of the neckband length L 44. In one example, the variable height H 46 decreases from a maximum height H 50 at the first neckband end 40 and the second neckband end 42 to a minimum height H 48 at a midpoint of the neckband length L 44. FIG. 2B illustrates a further embodiment having a reduced minimum height H 49 at the midpoint relative to minimum height H 48 in the embodiment of FIG. 2A (i.e., minimum height H 49<minimum height H 48). Advantageously, with a "bowtie" shape (as referred to by the inventors) in which the middle portion is thinner than the ends, weight is reduced in the most critical cantilevered section of the neckband length L 44 (i.e., at its midpoint, furthest from the earloops). Again, reduced weight at the midpoint results in less "bounce" during activities requiring vigorous movement such as running.

Advantageously, as illustrated in FIGS. 3, 5, and 6, the first neckband end 40 may include a first rigid plastic substrate 64 within the silicone rubber exterior and the second neckband end 42 may include a second rigid plastic substrate 66 within the silicone rubber exterior. The first rigid plastic substrate 64 and second rigid plastic substrate 66 extend approximately 15 mm from the left earloop 10 and right earloop 11, respectively. Left earloop 10 and right earloop 11 may include a stent into which first rigid plastic substrate 64 and plastic substrate 66 extend, respectively. The first rigid plastic substrate 64 and second rigid plastic substrate 66 advantageously reduce the overall length of cantilevered weight of the neckband 32 and function as a deadening agent to the bouncing force that would transfer through the earloops and eartips without them.

Figure 7:
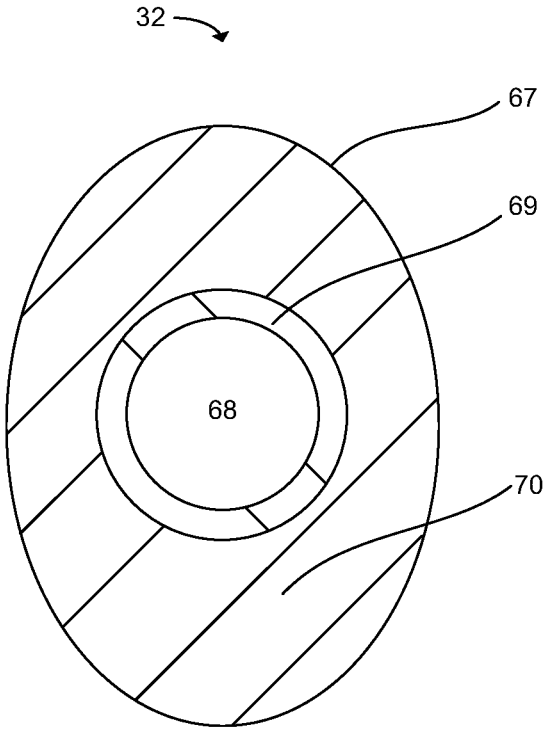
FIG. 7 illustrates a cross-section of the neckband shown in FIG. 1.

Advantageously, as illustrated in FIG. 7, the neckband length L 44 has an oval cross-section 67 in a y-z plane. The oval cross-section 67 is entirely filled with a physical material. The neckband length L 44 includes an electrical cable 68 at the neckband center, a fabric material 69 wrapping the electrical cable 68, and a silicone material exterior 70. Advantageously, the oval geometry reduces bouncing of the neckband relative to a circular cross section. The orientation is such that the cable is more flexible from left/right (i.e., along the x-axis) than up/down (i.e., along the y-axis), which further reduces bouncing under load. Similarly, the solid overmold further reduces undesirable bouncing.

Advantageously, as illustrated in FIG. 5, the neckband length L 44 is arranged at a raised angle 57 with respect to the z-axis in the y-z plane when the headset is worn on the user head. The first neckband end 40 and a left behind-the-ear segment 20 of the left earloop 10 form an acute angle 55 in the y-z plane. The right side components share a similar configuration. In this arrangement, the neckband 32 advantageously sits neutrally between the occipital bone and trapezius muscles when worn.

Figure 8:
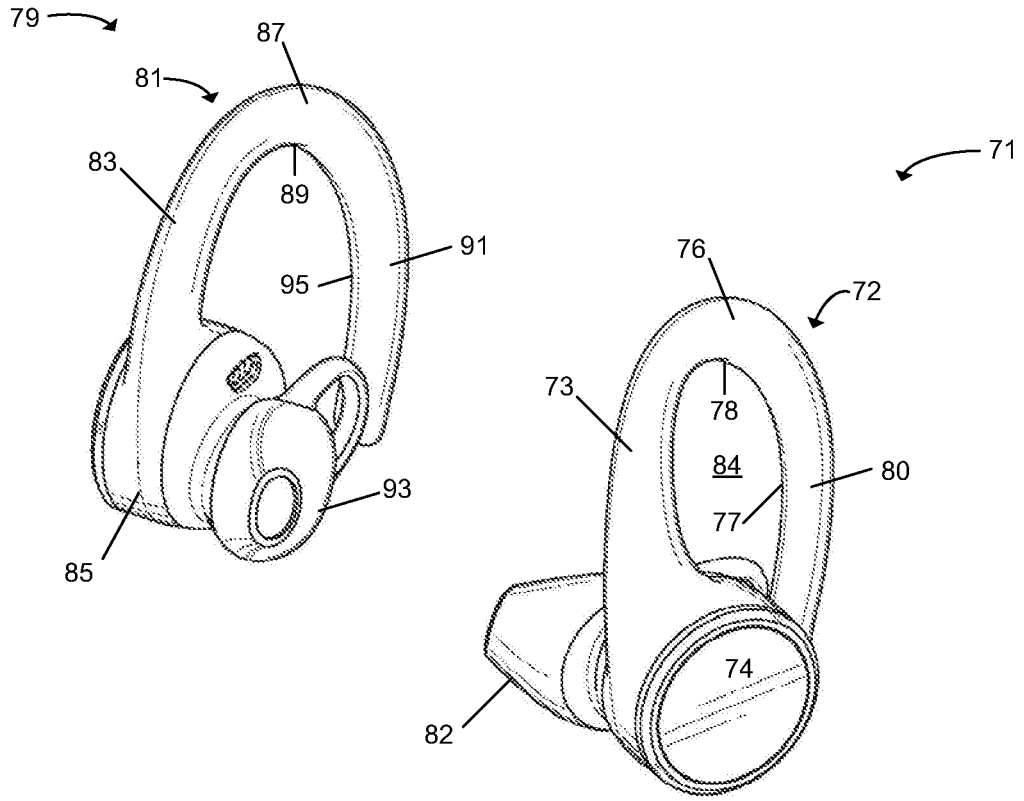
FIG. 8 illustrates a perspective view of a headset utilizing a left earpiece and a right earpiece in one example.
Figure 9:
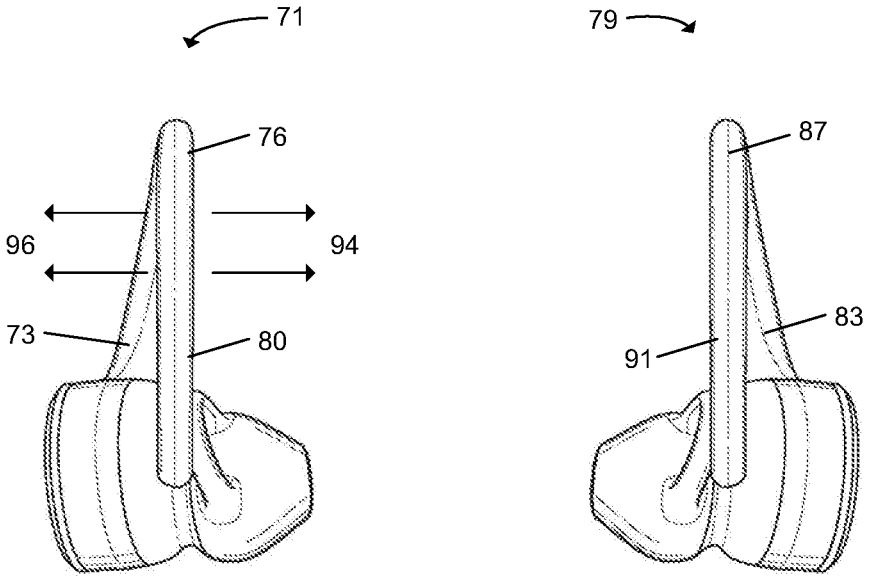
FIG. 9 illustrates a rear perspective view of the left earpiece and right earpiece shown in FIG. 8.
Figure 10:
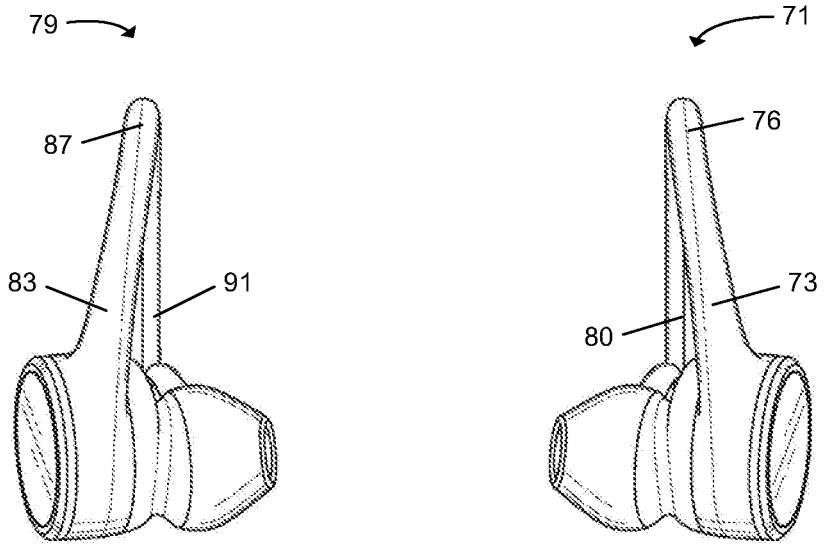
FIG. 10 illustrates a front perspective view of the left earpiece and right earpiece shown in FIG. 8.
Figure 11:
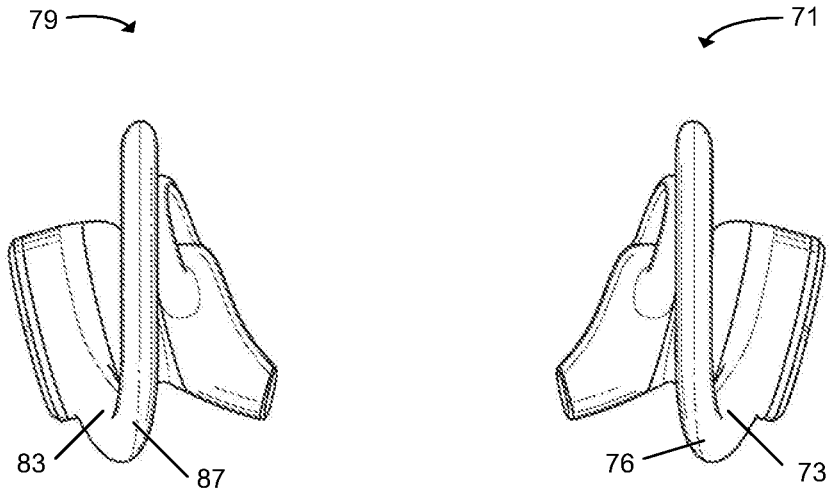
FIG. 11 illustrates a top view of the left earpiece and right earpiece shown in FIG. 8.
Figure 12:
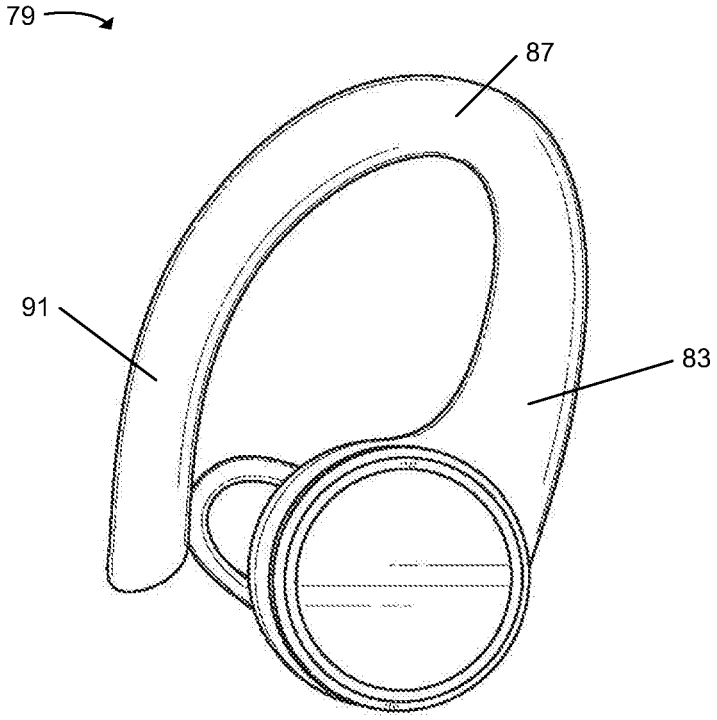
FIG. 12 illustrates a side view of the right earpiece shown in FIG. 8.
Figure 13:
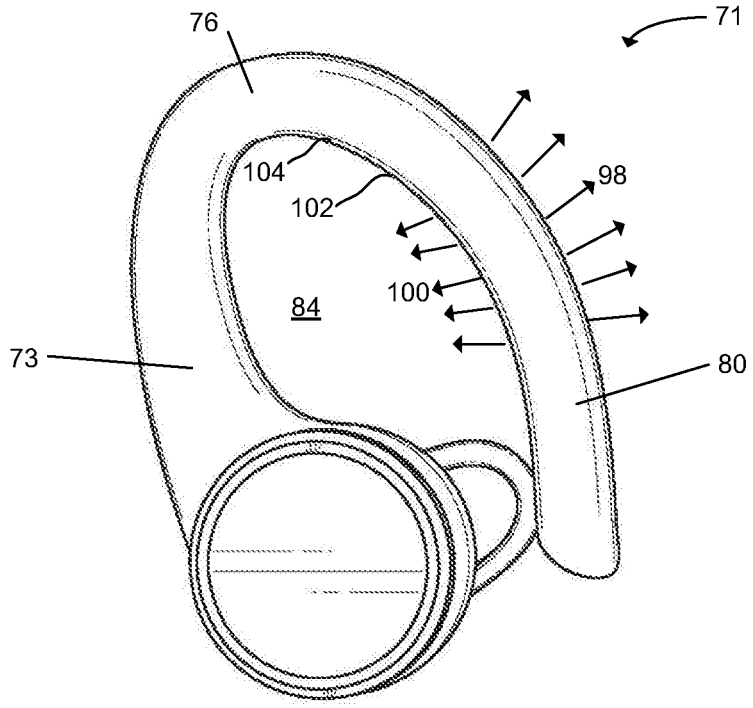
FIG. 13 illustrates a side view of the left earpiece shown in FIG. 8.
Figure 14:
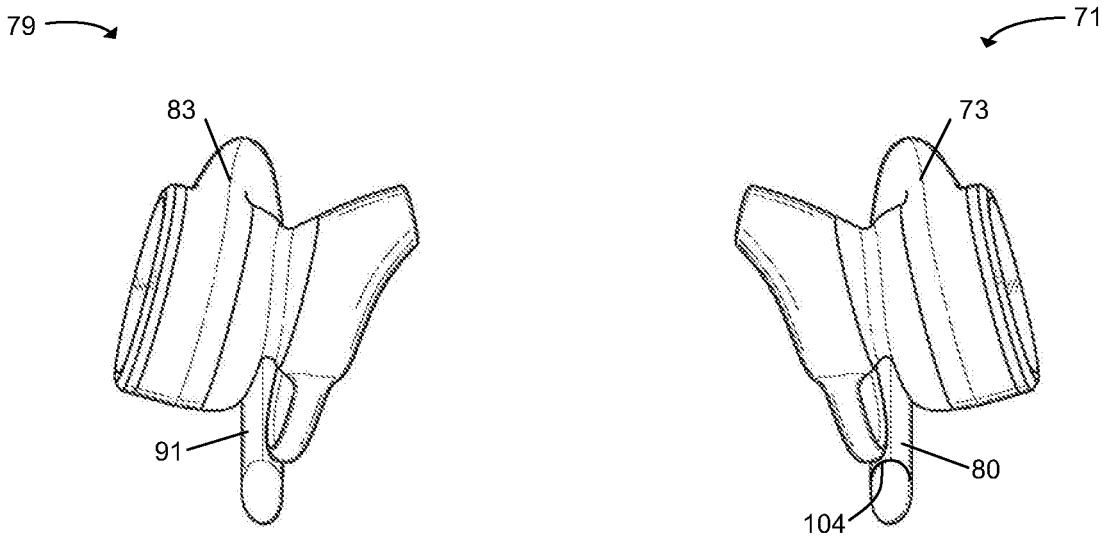
FIG. 14 illustrates a bottom view of the left earpiece and right earpiece shown in FIG. 8.

FIG. 8 illustrates a perspective view of a headset utilizing a left earpiece 71 and a right earpiece 79 in one example. FIGS. 9-11 illustrate a rear perspective view, front perspective view, and top view, respectively, of the left earpiece 71 and the right earpiece 79. FIGS. 12-13 illustrate a side view of the right earpiece 79 and the left earpiece 71, respectively. FIG. 14 illustrates a bottom view of the left earpiece 71 and right earpiece 79.

Left earpiece 71 and right earpiece 79 function together to output stereo sound. In a further embodiment, the headset includes only a single earpiece (i.e., left earpiece 71 or right earpiece 79). In addition to outputting sound, the headset may include a microphone and be operable as a telecommunications headset to conduct voice calls. The left earpiece 71 includes a left capsule 74, wherein the left capsule 74 includes a speaker arranged to output sound into an ear when the left earpiece 71 is worn. Located over the left speaker is a left eartip 82 arranged to stabilize the left earpiece 71 when inserted into the left ear. The left earpiece 71 includes a left earloop 72 extending from the left capsule 74. The left earloop 72 includes a left capsule connector segment 73 coupled to the left capsule 74, a left apex segment 76 having an adaptive left apex curvature 78 arranged to rest on an apex of the ear, and a left behind-the-ear segment 80 having an adaptive behind-the-ear curvature 77 arranged to curve behind the ear. The left apex segment 76 is between the left capsule connector segment 73 and the left behind-the-ear segment 80. The left capsule connector segment 73, the left apex segment 76, and the left behind-the-ear segment 80 define an open-ended curved space 84. In operation, the adaptive left apex curvature 78 and the adaptive behind-the-ear curvature 77 exert a resilient gripping tension behind the ear.

The left earloop 72 may be composed of a silicone rubber material having approximately 80 Shore-A hardness. Left earloop 72 may be constructed in the same manner as left earloop 10 discussed above. As illustrated in FIG. 14, the left earloop 72 includes a wide and rounded inner skin contact surface 104 arranged to sit on the apex of the ear and behind the ear. With this arrangement, left earloop 72 cradles over the apex and evenly distributes pressure, providing improved comfort. The left apex segment 76 has a width of approximately five mm.

The right earpiece 79 includes a right capsule 85, wherein the right capsule 85 includes a speaker arranged to output sound into an ear when the right earpiece 79 is worn. Located over the right speaker is a right eartip 93 arranged to stabilize the right earpiece 79 when inserted into the right ear. The right earpiece 79 includes a right earloop 81 extending from the right capsule 85. The right earloop 81 includes a right capsule connector segment 83 coupled to the right capsule 85, a right apex segment 87 having an adaptive right apex curvature 89 arranged to rest on an apex of the ear, and a right behind-the-ear segment 91 having an adaptive behind-the-ear curvature 95 arranged to curve behind the ear. The adaptive right apex curvature 89 and the adaptive behind-the-ear curvature 95 exert a resilient gripping tension behind the ear. Right earpiece 79 operates in a manner similar to left earpiece 71 and is not described separately.

The left capsule connector segment 73 is located along the x-axis at a different location than the left behind-the-ear segment 80 in both a left static non-worn state and a left static worn state. In one example, the left earloop 72 is substantially helical to achieve the desired positioning of the left capsule connector segment 73 and the left behind-the ear segment 80 along the x-axis. This arrangement provides an improved match with the ear anatomy, resulting in improved comfort. For example, the helical configuration assists in properly positioning the side of the behind-the-ear segment 80 to maximize contact with (i.e., "hug") the side of the user head.

Advantageously, as illustrated in FIG. 9, the left earloop 72 is resiliently flexible inward in a first direction 94 along the x-axis towards a side of a wearer head and resiliently flexible outward in a second direction 96 along the x-axis away from the side of the wearer head. As such, left earloop 72 has flexibility to ease donning and automatically adapts to a shape of the ear upon release by the user when the left earloop 72 flexes to rest at the necessary horizontal distance along the x-axis between the side of the user head and the capsule inserted in the user ear.

Advantageously, the left apex segment 76 and the left behind-the-ear segment 80 substantially define a first plane. The first plane intersects a y-z plane through a center of the capsule parallel to a wearer head. For example, first plane is at an angle of nine to thirteen degrees from the y-z plane through the center of the capsule. With this advantageous arrangement, the left earloop 72 twists inward to conform and cradle the user skull for a longer touch point, thereby improving comfort, stability, and allowing the headset to "disappear" from the users notice while wearing.

Advantageously, as illustrated in FIG. 13, the left earloop 72 is resiliently flexible outward in a first direction 98 in a y-z plane (i.e., along the z-axis and the y-axis) to increase the size of the open-ended curved space 84 and adjust a curvature 102 of an inner surface of the left earloop 72 during the donning process. Upon release by the user following donning, the left earloop 72 resiliently flexes back inward in a second direction 100 to reduce the size of the open-ended curved space 84, applying a grasping force on the ear resulting from the curvature 102 of the inner surface of the left earloop 72 automatically adapting (i.e., conforming) to a shape of the ear.

As a further advantage, the left apex segment 76 has a first flexibility amount in the first direction 98 and the left behind-the-ear segment 80 has a second flexibility amount in the first direction 98, wherein the first flexibility amount is greater than the second flexibility amount. The flexibility of the left earloop 72 tapers from the apex (softer is optimal) down to the bottom of the left earloop 72 (stiffer is optimal). This is achieved mostly by the inherent strength of the geometry of the earloop (i.e., the left apex segment 76) is more curved than the lower portion of the earloop (i.e., left behind-the-ear segment 80).

In operation, the left apex segment 76 deforms a greater amount to adjust the inner curvature of the left apex segment 76 than the amount the behind-the ear segment deforms for a given force applied by the user while donning the left earloop 72. The left capsule connector segment 73 may have little or no flexibility. The greater flexibility of the left apex segment 76 (and therefore greater adjustability of the inner curvature of the left apex segment 76) advantageously assists in the donning process when placing the earloop on the ear and furthermore allows the left apex segment 76 to comfortably, but firmly, grasp and conform to the ear apex upon completion of donning and while in a resting worn state.

Figure 15:
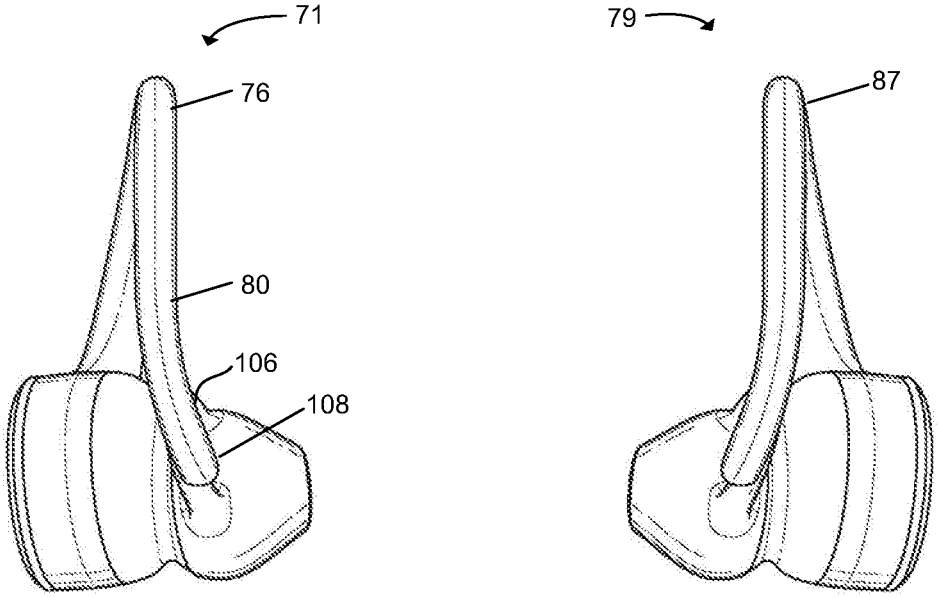
FIG. 15 illustrates a further embodiment of the earloop shown in FIG. 9.

As illustrated in FIG. 15, in a further embodiment, the left behind-the-ear segment 80 includes a side surface having a curvature 106 at a termination end 108 (i.e., the end opposite the left apex segment 76) directing the termination end 108 along the x-axis towards contact with the user head. For example, the termination end 108 may be five mm further along the x-axis towards the user head relative to the left behind-the-ear segment end at the left apex segment 76. With this advantageous arrangement, the left behind-the-ear segment 80 has increased contact area with (i.e., "hugs") the wearer's head.

While the exemplary embodiments of the present invention are described and illustrated herein, it will be appreciated that they are merely illustrative and that modifications can be made to these embodiments without departing from the spirit and scope of the invention. For example, the earloop can be used with any type of headset. As used herein, the term "headset" includes any type of head-worn device. Furthermore, the shapes and sizes of the illustrated capsules and eartips may be altered. In some instances, not all acts may be required to be implemented in a methodology described herein.

Thus, the scope of the invention is intended to be defined only in terms of the following claims as may be amended, with each claim being expressly incorporated into this Description of Specific Embodiments as an embodiment of the invention.

What is claimed is:

1. An earloop for wearing on an ear of a user head, the user head referenced by an x-axis in a width direction from ear-to-ear, a y-axis in a height direction from head-to-toe and a z-axis in a depth direction from face-to-occiput, the earloop comprising:

a capsule connector segment for coupling to a headset capsule;

an apex segment having an adaptive apex curvature arranged to rest on an apex of the ear; and a behind-the-ear segment having an adaptive behind-the-ear curvature arranged to curve behind the ear and exert a resilient gripping tension behind the ear, wherein the capsule connector segment is located along the x-axis at a different location than the behind-the-ear segment in both a static non-worn state and a static worn state, and wherein the apex segment is between the capsule connector segment and the behind-the-ear segment, and wherein the capsule connector segment, the apex segment, and the behind-the-ear segment define an open-ended curved space, and further wherein the apex segment and the behind-the-ear segment are resiliently flexible outward in a first direction in a y-z plane to increase a size of the open-ended curved space and adjust a curvature of an inner surface of the earloop arranged to contact the ear and resiliently flexible inward in a second direction to reduce the size of the open-ended curved space and conform to a user ear size, the apex segment having a first flexibility amount in the first direction and the behind-the-ear segment having a second flexibility amount in the first direction, wherein the first flexibility amount is greater than the second flexibility amount.

2. The earloop of claim 1 wherein the capsule connector segment, the apex segment, and the behind-the-ear segment form a substantially helical loop.

3. The earloop of claim 1, wherein the apex segment and the behind-the-ear segment comprise a rounded surface arranged to sit on the apex of the ear and behind the ear.

4. The earloop of claim 1, wherein the apex segment has a width of approximately 5 millimeters.

5. The earloop of claim 1, wherein the apex segment and the behind-the-ear segment substantially define a first plane, and wherein the first plane intersects a second y-z plane through a center of the headset capsule.

6. The earloop of claim 5, wherein the first plane is at an angle of nine to thirteen degrees from the y-z plane through the center of the headset capsule.

7. The earloop of claim 1, wherein the apex segment and the behind-the-ear segment are resiliently flexible inward in a third direction along the x-axis towards a side of a wearer head and resiliently flexible outward in a fourth direction along the x-axis away from the side of the wearer head.

8. The earloop of claim 1, wherein the behind-the-ear segment comprises a side surface comprising a second curvature at a termination end directing the termination end along the x-axis towards contact with the user head.

9. The earloop of claim 1, wherein the capsule connector segment, the apex segment and the behind-the-ear segment comprise a silicone rubber material having approximately 80 Shore-A hardness.

10. The earloop of claim 1, wherein the behind-the-ear segment is integrated with a neckband at a termination end opposite the apex segment.

11. A headset for wearing on a user head, the user head referenced by an x-axis in a width direction from ear-to-ear, a y-axis in a height direction from head-to-toe and a z-axis in a depth direction from face-to-occiput, the headset comprising:

a capsule, wherein the capsule comprises a speaker arranged to output sound into an ear when the headset is worn; and an earloop extending from the capsule, the earloop comprising a capsule connector segment coupled to the capsule, an apex segment having an adaptive apex curvature arranged to rest on an apex of the ear, and a behind-the-ear segment having an adaptive behind-the-ear curvature arranged to curve behind the ear, wherein the adaptive apex curvature and the adaptive behind-the-ear curvature exert a resilient gripping tension behind the ear, and wherein the capsule connector segment is located along the x-axis at a different location than the behind-the-ear segment in both a static non-worn state and a static worn state, wherein the apex segment is between the capsule connector segment and the behind-the-ear segment, and wherein the capsule connector segment, the apex segment, and the behind-the-ear segment define an open-ended curved space, and further wherein the apex segment and the behind-the-ear segment are resiliently flexible outward in a first direction in a y-z plane to increase a size of the open-ended curved space and adjust a curvature of an inner surface of the earloop arranged to contact the ear and resiliently flexible inward in a second direction to reduce the size of the open-ended curved space and conform to a user ear size, the apex segment having a first flexibility amount in the first direction and the behind-the-ear segment having a second flexibility amount in the first direction, wherein the first flexibility amount is greater than the second flexibility amount.

12. The headset of claim 11 wherein the earloop is substantially helical.

13. The headset of claim 11, wherein the apex segment and the behind-the-ear segment substantially define a first plane, wherein the first plane is in a different plane from a second y-z plane through a center of the capsule.

14. The headset of claim 13, wherein the first plane is at an angle of nine to thirteen degrees from the y-z plane through the center of the capsule.

15. A headset for wearing on a user head, the user head referenced by an x-axis in a width direction from ear-to-ear, a y-axis in a height direction from head-to-toe and a z-axis in a depth direction from face-to-occiput, the headset comprising:

a left capsule, wherein the left capsule comprises a left speaker arranged to output sound into a left ear when the headset is worn;

a left earloop extending from the left capsule, the left earloop comprising:

a left capsule connector segment coupled to the left capsule;

a left apex segment having an adaptive left apex curvature arranged to rest on a left apex of the left ear; and a left behind-the-ear segment having an adaptive left behind-the-ear curvature arranged to curve behind the left ear, wherein the adaptive left apex curvature and the adaptive left behind-the-ear curvature exert a left resilient gripping tension behind the left ear, wherein the left capsule connector segment is located along the x-axis at a different left location than the left behind-the-ear segment in both a left static non-worn state and a left static worn state, and wherein the left apex segment is between the left capsule connector segment and the left behind-the-ear segment, and wherein the left capsule connector segment, the left apex segment, and the left behind-the-ear segment define a left open-ended curved space, and further wherein the left apex segment and the left behind-the-ear segment are resiliently flexible outward in a first direction in a first y-z plane to increase a left size of the left open-ended curved space and adjust a left curvature of a left inner surface of the left earloop arranged to contact the left ear and resiliently flexible inward in a second direction to reduce the size of the left open-ended curved space and conform to a user left ear size, the left apex segment having a first flexibility amount in the first direction and the left behind-the-ear segment having a second flexibility amount in the first direction, wherein the first flexibility amount is greater than the second flexibility amount;

a right capsule, wherein the right capsule comprises a right speaker arranged to output sound into a right ear when the headset is worn;

a right earloop extending from the right capsule, the right earloop comprising:

a right capsule connector segment coupled to the right capsule;

a right apex segment having an adaptive right apex curvature arranged to rest on a right apex of the right ear; and a right behind-the-ear segment having an adaptive right behind-the-ear curvature arranged to curve behind the right ear, wherein the adaptive right apex curvature and the adaptive right behind-the-ear curvature exert a right resilient gripping tension behind the right ear, wherein the right capsule connector segment is located along the x-axis at a different right location than the right behind-the-ear segment in both a right static non-worn state and a right static worn state, and wherein the right apex segment is between the right capsule connector segment and the right behind-the-ear segment, and wherein the right capsule connector segment, the right apex segment, and the right behind-the-ear segment define a right open-ended curved space, and further wherein the right apex segment and the right behind-the-ear segment are resiliently flexible outward in a third direction in a second y-z plane to increase a right size of the right open-ended curved space and adjust a right curvature of a right inner surface of the right earloop arranged to contact the right ear and resiliently flexible inward in a fourth direction to reduce the size of the right open-ended curved space and conform to a user right ear size, the right apex segment having a third flexibility amount in the third direction and the right behind-the-ear segment having a fourth flexibility amount in the third direction, wherein the third flexibility amount is greater than the fourth flexibility amount; and a neckband integrated with the left earloop and the right earloop, wherein the neckband comprises a first end coupled to the left behind-the-ear segment and a second end coupled to the right behind-the-ear segment.

16. The headset of claim 15, wherein the left apex segment and the left behind-the-ear segment substantially define a first plane, wherein the first plane intersects a first y-z plane through a center of the left capsule, and wherein the right apex segment and the right behind-the-ear segment substantially define a second plane, wherein the second plane intersects a second y-z plane through a center of the right capsule.

17. The headset of claim 16, wherein the first plane is at a first angle of nine to thirteen degrees from the y-z plane through the center of the left capsule, and wherein the second plane is at a second angle of nine to thirteen degrees from the y-z plane through the center of the right capsule.

* * * * *